United States Patent [19]

Clapp

[11] Patent Number: 4,682,713

[45] Date of Patent: Jul. 28, 1987

[54] PRESSURIZED FLUID REMOTE-DISPENSER AND ASSEMBLY INCLUDING THE SAME

[75] Inventor: Clarence Clapp, Milford, Conn.

[73] Assignee: Microcare Chemical Corporation, Farmington, Conn.

[21] Appl. No.: 704,376

[22] Filed: Feb. 22, 1985

[51] Int. Cl.[4] ..... B65D 83/14; A46B 11/02

[52] U.S. Cl. ..... 222/153; 222/402.13; 222/402.14; 401/190; 239/574

[58] Field of Search ..... 222/402.11, 402.14, 222/402.15, 402.22, 402.23, 506, 529, 545, 505, 153, 192, 402.13; 239/573, 574, 578, 588, 337, 340; 401/190

[56] References Cited

U.S. PATENT DOCUMENTS

| | | | |
|---|---|---|---|
| 1,622,397 | 3/1927 | Schlaich | 138/110 |
| 3,107,826 | 10/1963 | Kruck | 239/573 X |
| 3,410,492 | 11/1968 | Douglas et al. | 222/402.14 X |
| 3,920,162 | 11/1975 | Kimura | 222/402.14 X |
| 3,987,942 | 10/1976 | Morane et al. | 222/402.15 |
| 4,350,299 | 9/1982 | Stephenson et al. | 239/588 X |
| 4,431,031 | 2/1984 | Ettlinger | 138/110 X |

FOREIGN PATENT DOCUMENTS

| | | | |
|---|---|---|---|
| 2273594 | 1/1976 | France | 239/337 |
| 331063 | 6/1958 | Switzerland | 222/402.22 |

*Primary Examiner*—Joseph J. Rolla
*Assistant Examiner*—Nils Pedersen
*Attorney, Agent, or Firm*—Victor E. Libert

[57] ABSTRACT

A pressurized fluid remote-dispensing assembly comprises a base unit which may be an aerosol container having a supply valve, an automatically disengageable locking rod or wedge for maintaining the aerosol container supply valve in an open, fluid dispensing valve position, a supply tube inserted into the aerosol outlet nozzle so as to allow for pressurized transfer of fluid through the tube to a remote dispenser, the locking rod or wedge being mated with the supply tube so that disengagement of the latter also disengages the locking rod or wedge to allow the supply valve to return to its normal, closed position. The remote dispenser may be equipped with a scrubber/applicator and stop means to prevent excessive upward pressure on the nozzle assembly of the remote dispenser and the supply tube may be encased in a protective sheathing.

14 Claims, 9 Drawing Figures

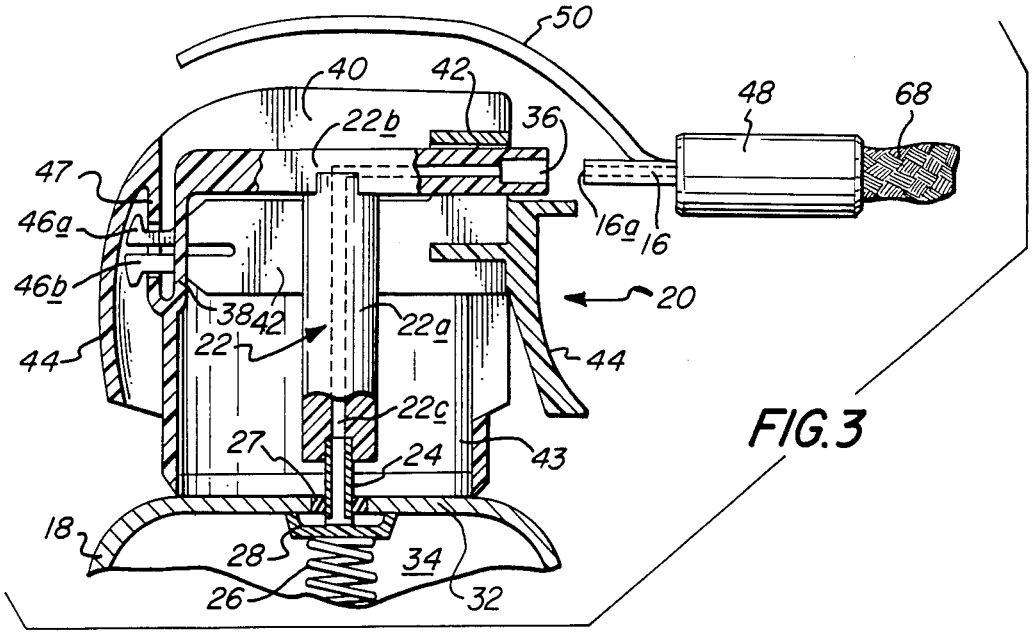
FIG. 3
FIG. 4A
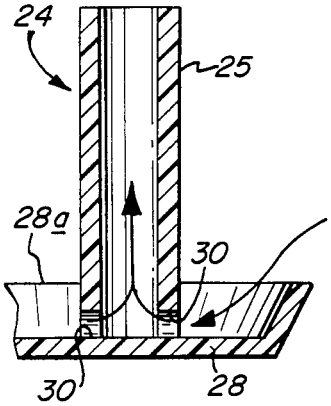
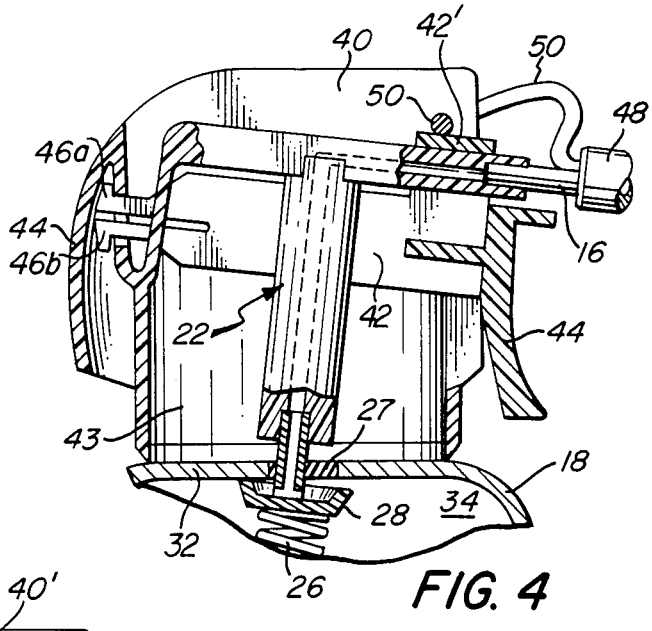
FIG. 4
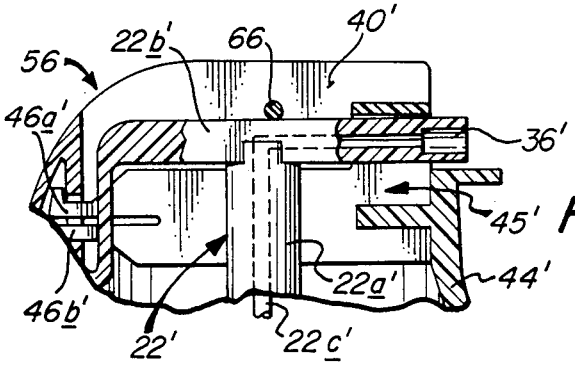
FIG. 5

PRESSURIZED FLUID REMOTE-DISPENSER AND ASSEMBLY INCLUDING THE SAME

BACKGROUND OF THE INVENTION

1. Field of the Invention

The present invention is concerned with portable pressurized container assemblies such as aerosol spray can assemblies and in particular with such assemblies comprising a pressurized base unit connected by a tube to a remote, hand-held dispenser to which the base unit supplies a pressurized fluid. Such devices find use in industrial applications for a variety of cleaning or other uses involving the delivery of a controlled spray of a substance, such as a solvent, cleaner or antistatic substance, by a pressurized container such as a conventional aerosol spray can.

It is often convenient or necessary, because of space limitations and to reduce operator fatigue, to utilize a remote dispenser attached to the pressurized base unit or supply container when it is desired to deliver a spray of a substance in connection with, for example, cleaning and removing solder from defective circuit boards for recycle in a manufacturing process, in cleaning internal components of optical devices (cameras, projectors, telescopes, etc.), electronics equipment (tape recording heads, etc.) and in cleaning or lubricating internal gears, electric motors and controls and the like. In such cases the manipulation of a conventional pressurized container containing a pound (0.45 kg) or more of solvent cleaning agent or other material is often awkward or impossible in tight quarters. When a remote dispenser is utilized, however, manual control at the remote dispenser of the assembly is necessary in order to avoid wasting the pressurized gas and the substance dispensed by it. In addition, an "off" and "on" control at the pressurized supply container to override the trigger on the remote dispenser is desirable in order to provide a shut-off means at the source of supply when the assembly is not in use.

2. Description of the Related Art

Stephenson et al U.S. Pat. No. 3,650,438 shows a remote-release pressurized container assembly having a remote, manually-operated nozzle wand supplied from an aerosol container, the output supply of which is controlled by a twistable container cap means mounted on the aerosol supply container. The twistable container cap means permits manually opening and closing the spray nozzle of the aerosol supply container which spray nozzle is connected by flexible tubing to the remote wand. Stephenson et al U.S. Pat. No. 4,278,188 and 4,350,299 each discloses an assembly consisting of an aerosol can connected by flexible tubing to a wand-like remote delivery nozzle which is equipped with a brush at the end thereof, described as an applicator brush in the U.S. Pat No. 4,350,299.

There are some difficulties associated with the known prior art devices. The flexible tubing connecting the aerosol spray container to the remote wand or dispenser may be connected to the aerosol can by being secured to a cap assembly which is specifically designed to accomodate it, which increases manufacturing costs. On the other hand, the tube end may be simply inserted into the discharge bore of the spray nozzle on the supply can. However, for reasons of economy it is desirable to use off-the-shelf stock plastic tubing and stock aerosol spray can nozzles and manufacturing tolerances for such stock items are such that the inserted tubing may readily be accidentally disengaged from the spray discharge opening in the supply container during movement of the remote dispenser by the operator. This is particularly so if the remote dispenser has thereon a brush which is used to scrub the device being treated. Since the nozzle on the aerosol spray container must be locked in the open or discharge position in order to provide a steady supply of fluid for control by manipulation of the trigger of the remote dispenser, accidental disengagement of the flexible tubing from the aerosol spray container nozzle results in a wasteful and possibly hazardous continuous discharge from the base or supply container until its nozzle can be turned off or the delivery tube reinserted.

Another difficulty is encountered in environments where there are heating elements, such as the soldering irons used in the repair and recycling of circuit boards, or sharp edges of tools or equipment being treated. In such use environments thermoplastic flexible tubing may be burned through or severed thereby disabling the apparatus and possibly incurring a fire or other hazard by uncontrolled discharge of the pressurized fluid. Yet another difficulty with prior art devices which include on the remote dispenser a brush or other means used to impart a scrubbing action, is that in manipulating the remote dispenser the operator may exert a force on it which forcibly disengages or breaks a component of the valve or release means remote dispenser, which is usually made of relatively lightweight plastic parts.

SUMMARY OF THE INVENTION

In accordance with the present invention there is provided pressurized fluid remote-dispensing assembly which comprises a base unit containing fluid under pressure, a remote fluid dispenser and a flexible supply tube connecting the base unit and the remote dispenser in fluid flow communication; (a) the base unit further comprising release means having a discharge opening therein through which fluid is discharged from the spray unit, a displaceable member component of a fluid supply valve assembly which is moveable with the displaceable member from a normally closed valve position to an open position in which the supply valve releases pressurized fluid from said discharge opening, and support means having thereon a locking seat positioned adjacent the displaceable member; (b) the supply tube having a supply end and a delivery end and being dimensioned and configured to have its supply end sealingly inserted into the discharge opening and its delivery end connected to the remote dispenser, the supply tube thereby serving to conduct fluid content of the base unit from the discharge opening thereof to the remote dispenser; and (c) locking means secured to the supply tube adjacent the supply end thereof and dimensioned and configured to be releasably received within the locking seat to thereby retain the displaceable member and the fluid supply valve in its open position, and to be disengaged from the locking seat to release the displaceable member and the fluid supply valve for return to the closed valve position upon disengagement of the supply tube from the discharge opening.

Another aspect of the invention provides that the locking seat comprise one or more apertures formed in the support means adjacent said displaceable member, and said locking means comprises a flexible elongate member dimensioned and configured to be insertable through said one or more apertures to retain said displaceable member and thereby said fluid supply valve in the open valve position.

In another aspect of the invention, the locking seat comprises shoulder means projecting from the support means adjacent to and spaced from said displaceable member, and said locking means is a wedge member insertable between said shoulder means and said displaceable member to retain the latter and thereby said fluid supply valve in the open valve position.

Another aspect of the invention provides that the flexible supply tube is encased in a protective sheathing, such as a flexible woven metal wire sheathing.

Other aspects of the invention provide the following features, singly or in any combination; the release means may further comprise a manually actuatable trigger means operable to move said displaceable member and thereby said fluid supply valve to its open valve position; the remote dispenser may comprise a handle means to which the supply tube is sealingly attached and a manually operated nozzle for dispensing therethrough pressurized fluid received from the base unit through the supply tube; the remote dispenser may include an outlet release means having an outlet opening therein through which fluid from an internal passageway of said dispenser is discharged, an outlet displaceable member component of a fluid outlet valve assembly which is moveable with the outlet displaceable member from a normally closed valve position to an open position in which the outlet valve releases pressurized fluid through said outlet opening, a manually actuatable outlet trigger means operable to displace said displaceable member to move the latter and thereby said fluid outlet valve to the open valve position; and, the remote dispenser may have a scrubber/applicator means mounted on the releases means and may further comprise second support means having mounted thereon stop means positioned adjacent the outlet displaceable member to limit movement thereof to the normal movement range between open and closed positions of said fluid outlet valve.

In one embodiment the locking means comprises a flexible rod-like member which extends outwardly of said fastening member and terminates in a distal end thereof which is dimensioned and configured to be insertable into said locking seat, said rod-like member being sufficiently flexible to disengage from said locking seat upon disengagement of the supply end of said transfer tube from said discharge opening.

Still another aspect of the invention provides an assembly wherein a segment of the supply tube and a segment of the flexible rod-like locking means are secured together in a fastening member from which the distal end of the locking means extends and from which a distal end of the supply tube extends for insertion into said discharge opening.

Yet another aspect of the invention provides a remote dispenser capable of being connected to an aerosol spray unit containing fluid under pressure and having a fluid supply nozzle moveable between its normally closed position and an open position in which fluid is discharged through a discharge opening therein, the remote dispenser comprising a device substantially as described above as part of the assembly.

BRIEF DESCRIPTION OF THE DRAWINGS

FIG. 3 is a section view in elevation of the release means and a top segment of the base unit of the assembly of FIG. 1 showing the release means in its normal, valve closed position and the supply tube and a locking means disengaged therefrom;

FIG. 4 is a view corresponding to FIG. 3 but showing the release means in the valve open position with the supply and locking means engaged therewith;

FIG. 4A is a partial view in elevation on an enlarged scale of a stem valve forming a part of a release means;

FIG. 5 is a partial elevation view in section of the outlet release means on the remote dispenser of the assembly of FIG. 1 with the release means in its valve closed position;

DESCRIPTION OF THE PREFERRED EMBODIMENTS

The pressurized fluid remote-dispensing assembly of the present invention may utilize as the base unit thereof a conventional pressurized aerosol spray can having a conventional manually actuatable discharge valve thereon. Such discharge valves conventionally comprise a stem valve having a delivery bore extending therethrough and including a flange and spring means arranged so that depression or tilting of the stem from its normally closed position permits entry of pressurized fluid from the interior of the spray can through a metering orifice opened by the tilting or depressing action and into the delivery bore of the valve for discharge from a spray delivery orifice at the discharge end of the bore. Such valves are well know in the art as shown, for example, by the aforesaid U.S. Pat. No. 3,650,438 and need not be described in detail herein. It is also known to provide on such aerosol spray cans a trigger means to engage the tiltable or depressable stem valve and a supply opening in a nozzle connected in flow communication with the delivery orifice of the stem valve so that the trigger may be used to discharge pressurized fluid from the aerosol can. Regardless of the specific valving and trigger configuration utilized, the aerosol spray unit thus has mounted thereon means which may be described as a release means, which includes a displaceable member which is operative to move the fluid supply valve from its normally closed valve position to an open valve position for release of pressurized fluid, e.g., as an aerosol spray, from the base unit.

Figure 1:
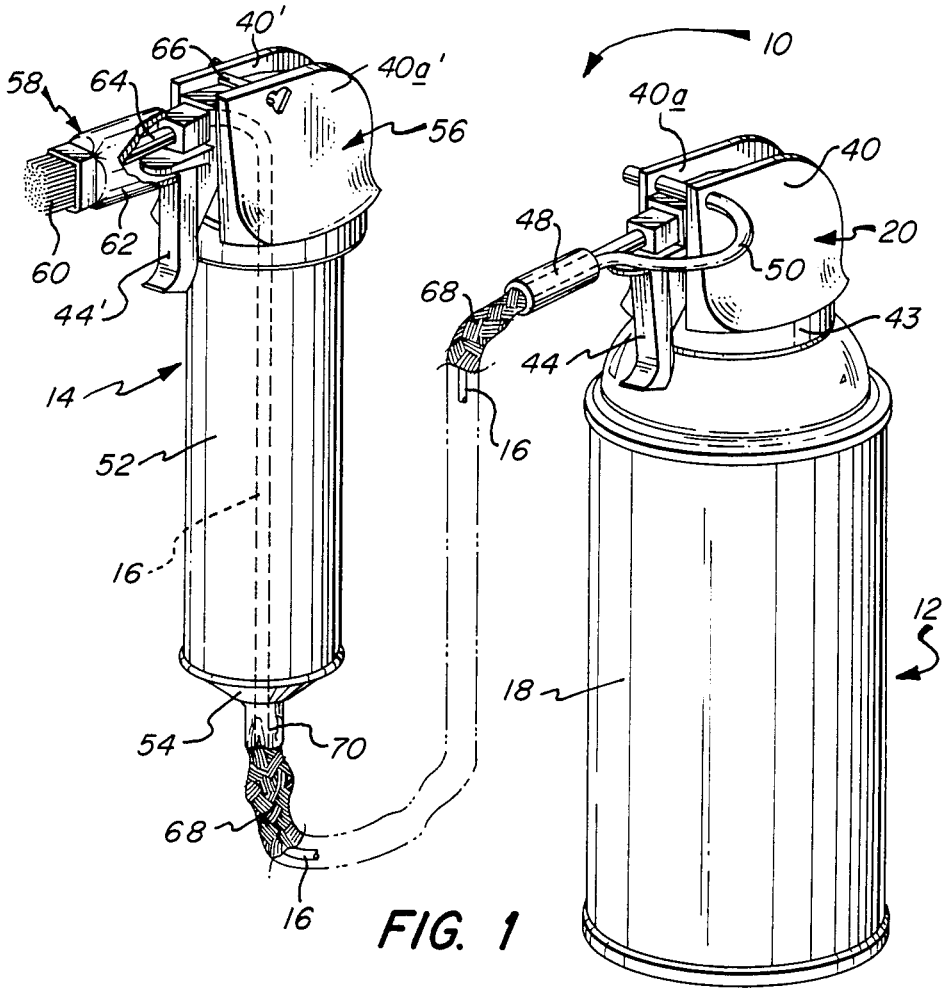
FIG. 1 is a perspective view of one embodiment of a pressurized fluid dispenser assembly of the invention.

Referring now to FIG. 1 there is shown a pressurized fluid remote-dispensing assembly comprising an aerosol spray assembly generally indicated at 10 and comprising a base unit 12 which may comprise an aerosol spray unit, a remote dispenser 14 and a flexible supply tube 16 connecting base unit 12 in fluid flow communication with fluid dispenser 14.

Base unit 12 includes a container 18, the interior of which provides a chamber for containing a fluid and pressurizing gas, as well known in the art, which pressurized gas serves to expel a substance contained within container 18 upon actuation of a release means generally indicated at 20. As best seen with reference to FIGS. 2, 3 and 4, release means 20 serves as a cap for base unit 12 and comprises a displaceable member 22 of generally T-shaped configuration which comprises a component of a fluid supply valve assembly including a stem valve 24 (shown in part in enlarged scale in FIG. 4A) having a spring 26 associated therewith and a stem 25 and base collar 28 which, when in the position illustrated in FIG. 3, seals off a delivery orifice 30 comprising apertures formed in the base of stem 25. Stem 25 is sealed in a gas-tight fashion by a flexible seal gasket 27 filled in an aperture (unnumbered) formed in the top wall 32 of the pressurized fluid-containing chamber 34 provided by container 18.

Figure 2:
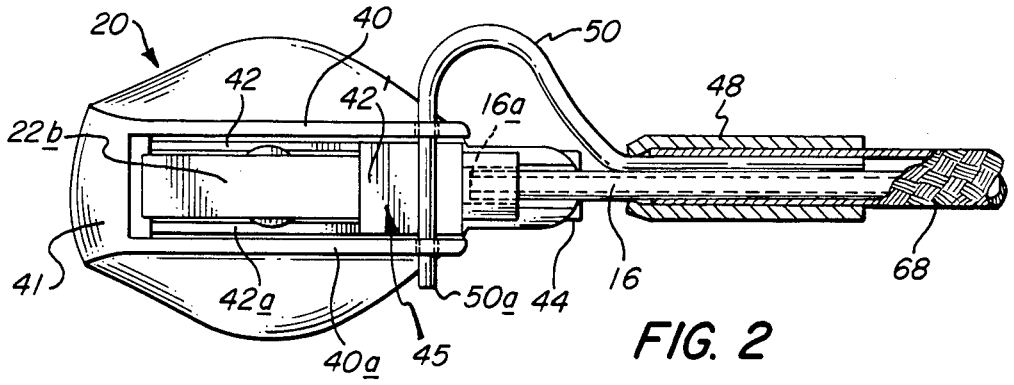
FIG. 2 is a top plan view of the release means (cap) and a segment of the supply tube of the assembly of FIG. 1.

Displaceable member 22 has a post portion 22*a* and a nozzle portion 22*b* which extends transversely of the post portion at one end, the upper end as viewed in FIGS. 3 and 4, thereof. A delivery bore 22*c* has an inverted L-shaped configuration as viewed in FIGS. 3 and 4 and is connected in flow communication to stem valve 24 at one end and terminates in discharge opening 36 at the distal end of nozzle portion 22*b*. The end of nozzle portion 22*b* opposite the end containing discharge opening 36 terminates in a flexible hinge 38 which is integral with and carried on a support means 41 which comprises, in the illustrated embodiment, a pair of upstanding, parallel spaced-apart sidewalls 40, 40*a* as shown in FIGS. 1 and 2 with displaceable member 22 supported therebetween. Support means 41 includes a cylindrical-shaped base 43 which is integral with and supports sidewalls 40, 40*a*. A trigger plate 45 is connected to displaceable member 22 and is of generally U-shaped configuration in plan view as seen in FIG. 2 and comprises a pair of parallel spaced-apart support plates 42, 42*a* connected by a bight portion 42'. As shown in FIGS. 3 and 4, bight portion 42' extends over the top of nozzle portion 22*b* of displaceable member 22 and terminates in a trigger 44 extending between and securing support plates 42, 42*a*. The opposite, distal ends of support plates 42, 42*a* each terminate in a pair of tangs 46*a*, 46*b* as shown in FIGS. 3 and 4. (Support plate 42*a* and its associated tangs are omitted from FIGS. 3 and 4 for clarity of illustration). Tangs 46*a* and 46*b* are received within an opening (unnumbered) formed in web 47 integral with and part of support means 41 and terminating at the base of hinge 38 to cooperate therewith in forming a Y-shaped configuration in the section view of FIGS. 3 and 4. Upon pressure being applied in a leftwardly and downwardly direction, as viewed in FIGS. 3 and 4, by squeezing trigger 44 support plates 42, 42*a* will pivot downwardly about the opening, in which tangs 46, 46*a* are mounted as shown in FIG. 4. Such downward pivoting action displaces stem valve 24 downwardly thereby disengaging the shoulder rim 28*a* of base collar 28 (FIG. 4A) from the underside of top wall 32 thereby permitting the pressurized fluid to escape from chamber 34 through delivery orifices 30 as shown by the arrow in FIG. 4A thence through delivery bore 22*c* into discharge opening 36. Release of the pressure on trigger 44 will cause spring 26, which is supported in a conventional and well known manner not illustrated, to return releaseable member 22 to its normal, valve closed position.

Supply tube 16 has its supply end 16*a* inserted through discharge opening 36 in a sealing manner so that fluid released through delivery bore 22*c* and discharge opening 36 must enter supply tube 16. Trigger 44 is then depressed to move displaceable member 22 to its position illustrated in FIG. 4 to open valve 24 and locking means 50 is then inserted through the aligned pair of apertures in sidewalls 40, 40*a* to retain displaceable member 22 in its open valve position as illustrated in FIG. 4. As seen in FIGS. 2 and 3, a segment of supply tube 16 adjacent its supply end 16*a* is crimped by a fastening member 48 together with a flexible, rod-like locking means 50. As best seen in FIGS. 2 and 3, a distal, supply end 16*a* of supply tube 16 extends beyond fastening member 48 as does a distal end 50*a* of locking means 50 which is flexible enough to be curved and inserted through a pair of aligned apertures (unnumbered) formed in respective sidewalls 40, 40*a* of support means 41. Locking means 50 is thus securely fastened to supply tube 16 adjacent the supply end 16*a* thereof so that should supply tube 16 be disengaged from discharge opening 36 as by a sharp jerking movement rightwardly as viewed in FIGS. 2, 3 and 4, locking means 50 is constrained to move with supply tube 16 and is flexible enough to be pulled out of the aligned apertures thereby releasing releaseable member 22 to return to its normal closed valve position. Thus, discharge of fluid from base unit 12 is automatically terminated upon disengagement of supply tube 16 from the discharge opening of base unit 12 and concomitant disengagement of locking means 50 from the aligned apertures in sidewalls 40, 40*a*.

Supply tube 16, as seen in FIG. 1, extends to a handle means 52 which, in the illustrated embodiment, comprises a hollow cylindrical shaped chamber having a lower, closed end 54 through which supply tube 16 extends to an outlet release means 56 mounted on the upper, opposite end of handle 52. Outlet release means 56 may be of similar or substantially identical construction to release means 20. That is, it may comprise a trigger actuated aerosol spray valve means mounted in the upper end (as viewed in FIG. 1) of handle 52. In the embodiment illustrated in FIG. 1, this structure of a conventional trigger operated aerosol valve has been modified only to the extent of adding thereto a scrubber/applicator 58 comprising, in the illustrated embodiment, a bristle brush 60 mounted in a hollow cylindrical ferrule 62 carried on a dispensing tube 64 which is received within the discharge opening 36' (FIG. 5) of nozzle portion 22*b'* of displaceable member 22' of outlet release member 56. Since outlet release means 56 provides a positive shut-off for fluid delivered under pressure through supply tube 16, release means 20 of base unit 12 may be locked by locking means 50 in its open position and the dispensing of the pressurized fluid controlled by trigger 44' of outlet release means 56. Inasmuch as outlet release means 56 may be similar or identical in structure and function to outlet release means 20 except for having a stop means instead of the locking seat provided by the apertures or shoulders which receive the locking means, it is not necessary to describe release means 56 in detail.

Because scrubber/applicator 58 when inserted into release chamber 36' may be used with a vigorous scrubbing action, there is a danger that displaceable member 22' may be forced upwardly as viewed in FIG. 5 under sufficient pressure to damage outlet release means 56 or disengage tangs 46*a'* and 46*b'* or otherwise cause damage thereto. Accordingly, a stop means 66 (FIGS. 1 and 5) is inserted through a pair of aligned apertures (unnumbered) formed in upstanding sidewalls 40', 40a' (FIG. 1) and permanently mounted therein. Stop means 66 thus controls upward movement as viewed in FIG. 5 of displaceable member 22' to within the normal open and closing range of displaceable member 22'. As used herein and in the claims, the term "scrubber/applicator" is broadly intended to encompass a brush, applicator, abrading means or the like, whether used for any one or more of scrubbing, painting, applying or the like.

Because the assembly 10 may be utilized in environments wherein supply tube 16 may be burned, cut or pinched, supply tube 16 may be encased within a protective sheathing 68 which may be any suitable, flexible protective sheathing such as a woven metal wire sheathing, a fiber glass sheathing or the like. Protective sheathing 68 serves to protect supply tube 16 against being burned through by contacting, for example, a soldering iron or the like, and from being inadvertently cut or damaged by sharp objects or tools. Supply tube 16 may be crimped by a fastener 70 to relieve strain on the end of supply tube 16 opposite to its supply end, i.e., its discharge end, which is suitably connected for dispensing under the control of outlet release means 56.

Figure 6:
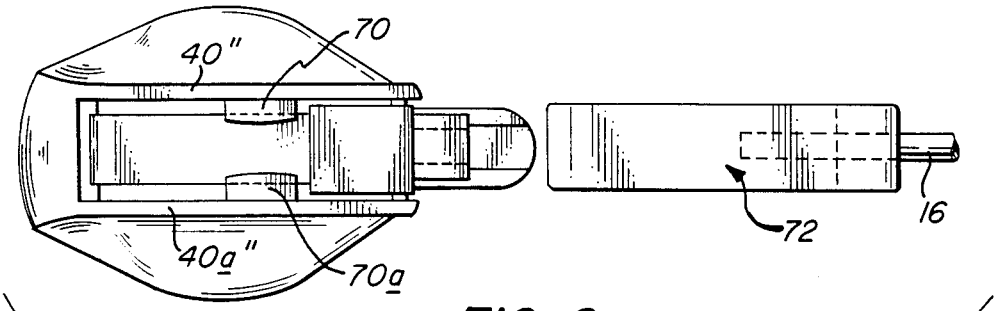
FIG. 6 is a plan view of another embodiment of the release means of the base unit of FIG. 1 showing the release means in its normal, valve closed position and the supply tube and locking means disengaged therefrom.
Figure 7:
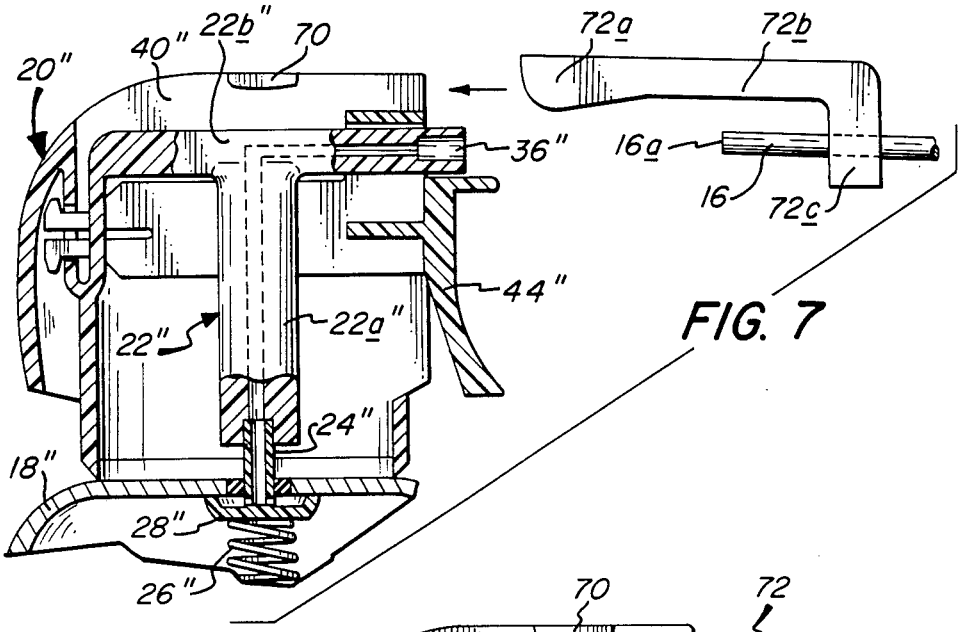
FIG. 7 is an elevation view in section of the release means and associated supply tube and locking means of FIG. 6 and also showing an upper segment of the base unit.
Figure 8:
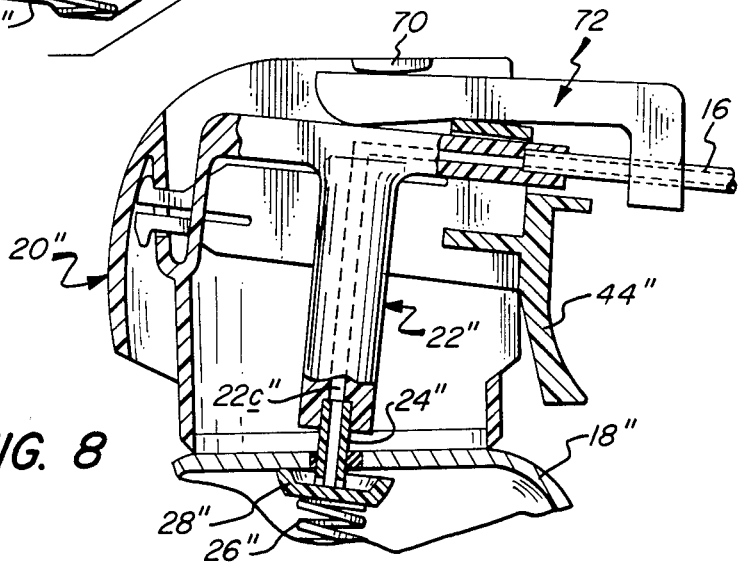
FIG. 8 is a view corresponding to FIG. 7 but showing the release means in the valve open position and the supply tube and locking means engaged therewith.

Referring now to FIGS. 6, 7, and 8, there is shown another embodiment of release means 20 in which parts identical thereto are identically numbered but with a double prime suffix. These identical parts function in exactly the same manner as do the parts of the embodiment of FIGS. 3 and 4 and accordingly, need not be additionally described herein. The embodiment of FIGS. 6, 7 and 8 differs from that of FIGS. 3 and 4 in that instead of the (unnumbered) apertures formed in sidewalls 40, 40a for receiving a flexible, rod-like locking member 50, sidewalls 40'', 40a'' have respectively formed therein a pair of shoulders 70, 70a facing and extending towards each other. In this embodiment, in lieu of flexible, rod-like locking means 50, there is provided a locking means 72 which, as best seen in FIGS. 7 and 8 is of wedge-like configuration, having a wide, distal end 72a which tapers to a thinner central section 72 *b* and terminates in a transversely extending mounting section 72c which has an aperture (unnumbered) therein through which supply tube 16 extends, whereby locking means 72 is mounted adjacent the supply end 16a of supply tube 16. Supply tube 16 is secured permanently within the (unnumbered) aperture in mounting section 72c as by being slightly crimped or by any suitable fastening means including adhesives, a threaded fitting or the like. Supply end 16a of supply tube 16 is inserted into discharge chamber 36'' and trigger 44'' is depressed to move displaceable member 22'' to the valve open position shown in FIG. 8. Wide end 72a of locking means 72 is then inserted between facing, extending shoulders 70, 70a in a direction moving leftwardly as viewed in FIGS. 6, 7 and 8 so that the lower portion (as viewed in the drawings) of locking means 72 bears on nozzle portion 22b'' of displaceable member 22'' to retain displaceable member 22'' and its associated valve in place. In this manner, in case supply tube 16 is dislodged from discharge chamber 36'' by rightward movement as viewed in the drawings, locking member 72 is constrained to follow therewith thereby releasing displaceable member 22'' for return to its normal valve closed position by the biasing action of spring 26''.

While the invention has been described in detail with reference to specific preferred embodiments thereof, it will be appreciated that those skilled in the art, upon a reading and understanding of the foregoing, may readily envision numerous alterations and modifications thereto which alterations and modifications are nonetheless within the spirit and scope of the invention and the appended claims.

What is claimed is:

1. A pressurized fluid remote-dispensing assemsbly comprises a base unit defining a chamber containing fluid under pressure, a remote fluid dispenser and a flexible supply tube connecting the base unit and the remote dispenser in fluid flow communication;

(a) the base unit further comprising (i) release means having a discharge opening therein through which fluid is discharged from the base unit, (ii) a displaceable member component of a fluid supply valve assembly, said assembly being moveable with the displaceable member from a normally closed valve position to an open position in which the supply valve releases pressurized fluid from said discharge opening, and (iii) support means having therein a locking seat positioned adjacent the displaceable member;

(b) the supply tube having a supply end and a delivery end and being dimensioned and configured to have its supply end sealingly inserted into the discharge opening and its delivery end connected to the remote dispenser, the supply tube thereby serving to conduct fluid content of the base unit from the discharge opening thereof to the remote dispenser; and (c) locking means secured to the supply tube adjacent the supply end thereof and dimensioned and configured to be releasably received within the locking seat to thereby retain the displaceable member and the fluid supply valve in its open position, and to be disengaged from the locking seat to release the displaceable member and the fluid supply valve for return to the closed valve position upon disengagement of the supply tube from the discharge opening.

2. The assembly of claim 1 wherein said locking seat comprises one or more apertures formed in the support means adjacent said displaceable member, and said locking means comprises a flexible elongate member dimensioned and configured to be insertable through said one or more apertures to retain said displaceable member and thereby said fluid supply valve in the open valve position.

3. The assembly of claim 1 wherein said locking seat comprises shoulder means projecting from the support means adjacent to and spaced from said displaceable member, and said locking means is a wedge member insertable between said shoulder means and said displaceable member to retain the latter and thereby said fluid supply valve in the open valve position.

4. The assembly of claim 1 wherein said supply tube is encased in a protective sheathing.

5. The assembly of claim 4 wherein the protective sheathing is a flexible woven metal wire sheathing.

6. The assembly of claim 1 wherein said remote dispenser comprises a handle means to which the supply tube is sealingly attached and a manually operated nozzle for dispensing therethrough pressurized fluid received from the base unit through the supply tube.

7. The assembly of claim 1 wherein said remote dispenser includes: an outlet release means having an outlet opening therein through which fluid from an internal passageway of said dispenser is discharged; an outlet displaceable member component of a fluid outlet valve assembly which is moveable with the outlet displaceable member from a normally closed valve position to an open position in which the outlet valve releases pressurized fluid through said outlet opening; and a manually actuatable outlet trigger means operable to displace said displaceable member to move the latter and thereby said fluid outlet valve to the open valve position.

8. The assembly of claim 7 wherein said remote dispenser has a scrubber/applicator means mounted on said release means and further comprises second support means having mounted thereon stop means positioned adjacent the outlet displaceable member to limit movement thereof to the normal movement range between open and closed positions of said fluid outlet valve.

9. A pressurized fluid remote-dispensing assembly comprises a base unit defining a chamber containing fluid under pressure, a remote fluid dispenser and a flexible supply tube connecting the base unit and the remote dispenser in fluid flow communication;

(a) the base unit further comprising (1) a displaceable member component of a fluid supply valve assembly, said assembly being moveable with the displaceable member from a normally closed valve position to an open position in which the supply valve releases pressurized fluid from a discharge opening, (ii) support means having therein a locking seat positioned adjacent the displaceable member, and (iii) release means having said discharge opening therein through which fluid is discharged from the base unit and a manually actuatable trigger means operable to move said displaceable member and thereby said fluid supply valve to the open valve position;

(b) the supply tube having a supply end and a delivery end and being dimensioned and configured to have its supply end sealingly inserted into the discharge opening and its delivery end connected to the remote dispenser, the supply tube thereby serving to conduct fluid content of the base unit from the discharge opening thereof to the remote dispenser; and (c) locking means secured to the supply tube adjacent the supply end thereof and dimensioned and configured to be releasably received within the locking seat to thereby retain the displaceable member and the fluid supply valve in its open position, and to be disengaged from the locking seat to release the displaceable member and the fluid supply valve for return to the closed valve position upon disengagement of the supply tube from the discharge opening.

10. A pressurized fluid remote-dispensing assembly comprises a base unit defining a chamber containing fluid under pressure, a remote fluid dispenser and a flexible supply tube connecting the base unit and the remote dispenser in fluid flow comnunication;

(a) the base unit further comprising release means having a discharge opening therein through which fluid is discharged from the base unit, a displaceable member component of a fluid supply valve assembly which is moveable with the displaceable member from a normally closed valve position to an open position in which the supply valve releases pressurized fluid from said discharge opening, and support means having therein a locking seat positioned adjacent the displaceable member;

(b) the supply tube having a supply end and a delivery end and being dimensioned and configured to have its supply end sealingly inserted into the discharge opening and its delivery end connected to the remote dispenser, the supply tube thereby serving to conduct fluid content of the base unit from the discharge opening thereof to the remote dispenser; and (c) locking means comprising a flexible rod-like member having one end secured to the supply tube adjacent the supply end thereof and an opposite distal end which is dimensioned and configured to be insertable into and releasably received within said locking seat to thereby retain the displaceable member and the fluid supply valve in its open position, said rod-like menber being sufficiently flexible to disengage from said locking seat to release the displaceable member and the fluid supply valve for return to the closed valve position upon disengagement of the supply end of said supply tube from said discharge opening.

11. The assembly of claim 10 wherein a segment of said supply tube and a segment of said locking means are secured together in a fastening member from which said distal end of said locking means extends, and from which a distal end of the transfer tube extends for insertion into said discharge opening.

12. A pressurized fluid remote-dispenser capable of being connected to a base unit containing fluid under pressure, the base unit having a fluid supply nozzle moveable between its normally closed position and an open position in which fluid is discharged through a discharge opening therein, the remote-dispenser comprising:

(a) a handle means;

(b) a flexible supply tube sealingly attached to the remote-dispenser to receive pressurized fluid from the base unit;

(c) an outlet release means having (i) an outlet opening through which is transmitted fluid from an internal passageway of said remote-dispenser, (ii) an outlet displaceable member comprising a component of an assembly including a fluid outlet valve which is moveable with the outlet displaceable member from a normally closed valve position to an open position in which the outlet valve releases pressurized fluid through said outlet opening, (iii) a manually actuatable outlet trigger means operable to displace said displaceable member to move the latter and said fluid outlet valve to its open valve position, and (iv) a scrubber applicator means mounted on said outlet displaceable member for movement therewith; and (d) second support means having stop means mounted thereon adjacent the outlet displaceable member to limit movement thereof to the normal movement range between open and closed positions of said fluid outlet valve.

13. The dispenser of claim 12 wherein said supply tube has joined thereto a locking means dimensioned and configured to engage a fluid supply valve in the base unit to retain such fluid supply valve in an open fluid-discharging position and said supply tube has a supply end dimensioned and configured for insertion into a discharge opening of the fluid supply valve of the base unit whereby, upon disengagement of the supply end of the transfer tube from the discharge opening of the fluid supply valve of the base unit, the locking means is also disengaged from the fluid supply valve to permit return of the fluid supply valve to its closed position.

14. The dispenser of claim 12 wherein the supply tube is encased in a protective sheathing.

* * * * *

UNITED STATES PATENT AND TRADEMARK OFFICE

CERTIFICATE OF CORRECTION

PATENT NO. :4,682,713

DATED :July 28, 1987

INVENTOR(S) :Clarence Clapp

It is certified that error appears in the above—identified patent and that said Letters Patent is hereby corrected as shown below:

Column 8, line 8, in the first line of claim 1 replace "assemsbly" with --assembly--

Column 9, line 24, in the first line of paragraph (a) of claim 9 replace "(1)" with --(i)--

Column 9, line 60, in the fifth line of claim 10 replace "comnunication;" with --communication--

Column 10, line 18, in the eighth line of paragraph (c) of claim 10 replace "menber" with --member--

Signed and Sealed this

Twenty-fourth Day of November, 1987

*Attest:*

DONALD J. QUIGG

*Attesting Officer*

*Commissioner of Patents and Trademarks*